US005174911A

United States Patent [19]

Lin et al.

[11] Patent Number: 5,174,911

[45] Date of Patent: * Dec. 29, 1992

[54] DRYER SHEET FABRIC CONDITIONER CONTAINING COMPATIBLE SILICONES

[75] Inventors: Samuel Lin, Paramus; Timothy Taylor, Hoboken, both of N.J.

[73] Assignee: Lever Brothers Company, Division of Conopco, Inc., New York, N.Y.

[ * ] Notice: The portion of the term of this patent subsequent to Nov. 12, 2008 has been disclaimed.

[21] Appl. No.: 532,488

[22] Filed: Jun. 1, 1990

[51] Int. Cl.[5] ..... D06M 10/08

[52] U.S. Cl. ..... 252/8.6; 252/8.7; 252/8.75; 252/8.8; 252/8.9; 252/174.15

[58] Field of Search ..... 252/8.6, 8.8, 174.15, 252/8.7, 8.75, 8.9

[56] References Cited

U.S. PATENT DOCUMENTS

| | | | |
|---|---|---|---|
| 3,032,577 | 5/1962 | Morehouse . | |
| 3,402,191 | 9/1968 | Morehouse . | |
| 3,624,120 | 11/1971 | Yetter . | |
| 3,655,420 | 4/1972 | Tichenor | 252/8.6 |
| 3,860,709 | 1/1975 | Abbott et al. . | |
| 3,972,131 | 8/1976 | Rudy et al. . | |
| 4,137,180 | 1/1979 | Naik et al. . | |
| 4,446,033 | 5/1984 | Barrat et al. . | |
| 4,450,152 | 5/1984 | Ona et al. . | |
| 4,485,090 | 11/1984 | Chang . | |
| 4,507,455 | 3/1985 | Tangney et al. . | |
| 4,514,319 | 4/1985 | Kulkarni et al. . | |
| 4,585,563 | 4/1986 | Basch et al. | 252/8.8 |
| 4,661,267 | 4/1987 | Dekker et al. . | |
| 4,661,269 | 4/1987 | Trinh et al. . | |
| 4,724,089 | 2/1988 | Konig et al. . | |
| 4,757,121 | 7/1988 | Tanaka et al. . | |
| 4,767,547 | 8/1988 | Straathof et al. . | |
| 4,789,491 | 12/1988 | Chang et al. . | |
| 4,800,026 | 1/1989 | Coffindaffer et al. . | |
| 4,806,255 | 2/1989 | Konig et al. . | |
| 4,818,242 | 4/1989 | Burmeister et al. . | |
| 4,911,852 | 3/1990 | Coffindiffer et al. | 252/174.15 |
| 4,933,097 | 6/1990 | Keegan | 252/88 |
| 4,994,593 | 2/1991 | Lin et al. . | |
| 5,064,544 | 11/1991 | Lin et al. | 252/8.8 |

FOREIGN PATENT DOCUMENTS

| | | |
|---|---|---|
| 0255711 | 10/1988 | European Pat. Off. . |
| 4936726 | 4/1984 | Japan . |
| 62-78277 | 4/1987 | Japan . |
| 1447254 | 8/1976 | United Kingdom . |
| 1549180 | 7/1979 | United Kingdom . |

OTHER PUBLICATIONS

Chemistry and Technology of Silicones.

*Primary Examiner*—Paul Lieberman
*Assistant Examiner*—William S. Parks
*Attorney, Agent, or Firm*—Rimma Mitelman

[57] ABSTRACT

Fabric conditioning compositions for coating a flexible substrate for subsequent use in a mechanical tumble dryer are disclosed. The compositions incorporate compatible organosilicones which form mutually stable mixtures with common fabric softening agents.

25 Claims, No Drawings

DRYER SHEET FABRIC CONDITIONER CONTAINING COMPATIBLE SILICONES

BACKGROUND OF THE INVENTION

1. Field Of The Invention

The instant invention relates to application of adjuvants to fabrics in tumble-dryer automatic dryers. More particularly, it relates to an article in the form of a flexible substrate carrying a fabric conditioning composition.

2. Related Art

Silicones have been applied to fabrics during manufacture of fabrics or during the make up of articles of clothing using processes such as padding or spraying. With respect to application of silicones to fabrics during a laundry process, Great Britain Patent Application 1,549,180; Burmeister et al., U.S. Pat. No. 4,818,242; Konig et al., U.S. Pat. No. 4,724,089; Konig et al., U.S. Pat. No. 4,806,255; Dekker et al., U.S. Pat. No. 4,661,267 and Trinh et al , U.S. Pat. No. 4,661,269 describe aqueous dispersions or emulsions of certain silicones of limited viscosity incorporated in liquid rinse-cycle fabric softening compositions. The compositions disclosed in the art are rinse-cycle aqueous dispersions. A fabric softening composition containing emulsified silicone combined with conventional cationic softening agent is also taught by Barrat et al. in U.S. Pat. No. 4,446,033. The compositions are taught for use during the aqueous rinse cycle of a laundry process.

The application of fabric softeners to fabrics in the tumble dryer by use of a flexible substrate carrying the fabric softeners is known in the art. The advantages of dryer added fabric conditioning include a more convenient time of addition in the laundry process and avoidance of undesirable interaction of softening agents with detergents.

Rudy et al., U.S. Pat. No. 3,972,131 discloses dryer sheets including a silicone oil as an ironing aid. Kasprzak et al., U.S. Pat. No. 4,767,548 discloses the use of certain silicones in dryer sheet formulations. Coffindafer et al., U.S. Pat. No. 4,800,026 discloses curable amine functional silicones in fabric care compositions.

In the manufacture of the dryer added fabric conditioning sheets described in the references mentioned above, when silicones are mixed with fabric softeners, the resulting mixtures are non-homogeneous and phase separation occurs readily. The homogeneity of such mixtures is ensured only by continuous vigorous agitation. An additional problem associated with the use of a nonhomogeneous mixture is the separation of actives at the point of application of the active mixture on the substrate resulting in unevenly impregnated sheets.

Critically, in the compatible mixtures described herein, the compatible organosilicines do not separate from fabric softening agents during coating or drying of the dryer sheets. Thus, the present invention affords easier processing of dryer added fabric conditioning sheets. Additionally, even and uniform distribution of the actives on the dryer sheet can be attained, alleviating the problem of unevenly impregnated sheets.

Accordingly, it is an object of the present invention to provide an article which provides for release of a fabric conditioning composition within an automatic laundry dryer, the composition containing a compatible mixture of a fabric softening component and a selected organosilicone.

These and other objects and advantages will appear as the description proceeds.

SUMMARY OF THE INVENTION

The present invention is based, in part, on the discovery that specific silicones, defined herein as compatible, are capable of forming compatible mixtures with certain conventional fabric softening agents.

It is important to differentiate between compatible and incompatible silicones and between compatible and incompatible mixtures of silicones and fabric softeners. Compatibility as taught herein is critical and is ascertained by the appearance and behavior of the mixture of silicone and fabric softener. When a silicone and a fabric softener are heated and mixed together, the resulting mixtures are either clear or cloudy. In the clear mixtures, the silicone and the fabric softener are mutually soluble and the clear mixtures are compatible. In the cloudy mixtures, the silicone and the fabric softener may or may not form mutually stable dispersions. A mutually stable dispersion is also compatible and is formed if a mixture of a silicone and a fabric softener does not separate into more than one phase on storage at elevated temperatures and if the mixture does form a uniform liquid or solid on cooling. Thus, the class of compatible mixtures as defined herein includes mutually soluble mixtures of a silicone and a fabric softener as well as mixtures wherein a silicone and a fabric softener form mutually stable dispersions. Compatibility of the mixture is critical and is determined by the Silicone/-Softener Compatibility Test (SSCT) described below.

In its broadest aspect, the objects of the invention are accomplished by an article comprising a flexible substrate carrying an effective amount of a fabric conditioning composition affixed thereto in a manner which provides for release of the conditioning composition within an automatic tumble dryer at dryer operating temperatures.

The fabric conditioning composition employed in the present invention contains (A) certain fabric softening agents used singly or in admixture with each other and (B) an organosilicone having specific structural requirements and a specific $\%CH_2$ content.

Component (A) includes conventionally used cationic and nonionic fabric softening agents, such as (i) cationic quaternary ammonium salts;

(ii) nonionic softeners selected from the group of tertiary amines having at least one $C_{8-30}$ alkyl chain, esters of polyhydric alcohols, fatty alcohols, ethoxylated fatty alcohols, alkylphenols, ethoxylated alkylphenols, ethoxylated fatty amines, ethoxylated monoglycerides, ethoxylated diglycerides, mineral oils, polyols, and mixtures thereof;

(iii) carboxylic acids having at least 8 carbon atoms; and (iv) mixtures thereof.

Component (B) includes organosilicones which are capable of forming compatible mixtures with the fabric softening agents of Component (A). The organosilicones of this invention are alkylsilicones or alkylaminosilicones having specific structural requirements defined in the detailed description that follows and having a $\%CH_2$ content of about 25% to about 90%.

Components (A) and (B) also must form a compatible mixture as determined by the Silicone/Softener Compatibility Test (SSCT).

Each of components (A) and (B) employed in the invention provides fabric conditioning benefits such as softness, fluffiness, static control, ironing ease, and other benefits when fabrics are commingled with articles of the invention in a tumble dryer.

DETAILED DESCRIPTION OF THE INVENTION

An article is disclosed for conditioning fabrics in a tumble dryer. The article of the invention comprises a flexible substrate which carries a fabric conditioning amount of a conditioning composition and is capable of releasing the conditioning composition at dryer operating temperatures. The conditioning composition in turn has a preferred melting (or softening) point of about 25° C. to about 150° C.

The fabric conditioning composition employed in the invention is coated onto a dispensing means which effectively releases the fabric conditioning composition in a tumble dryer. Such dispensing means can be designed for single usage or for multiple uses. One such article comprises a sponge material releasably enclosing enough of the conditioning composition to effectively impart fabric softness during several drying cycles. This multi-use article can be made by filling a porous sponge with the composition. In use, the composition melts and leaches out through the pores of the sponge to soften and condition fabrics. Such a filled sponge can be used to treat several loads of fabrics in conventional dryers, and has the advantage that it can remain in the dryer after use and is not likely to be misplaced or lost.

Another article comprises a cloth or paper bag releasably enclosing the composition and sealed with a hardened plug of the mixture. The action and heat of the dryer opens the bag and releases the composition to perform its softening.

A highly preferred article comprises the compositions containing a softener and a compatible organosilicone releasably affixed to a flexible substrate such as a sheet of paper or woven or nonwoven cloth substrate. When such an article is placed in an automatic laundry dryer, the heat, moisture, distribution forces and tumbling action of the dryer removes the composition from the substrate and deposits it on the fabrics.

The sheet conformation has several advantages. For example, effective amounts of the compositions for use in conventional dryers can be easily absorbed onto and into the sheet substrate by a simple dipping or padding process. Thus, the end user need not measure the amount of the composition necessary to obtain fabric softness and other benefits. Additionally, the flat configuration of the sheet provides a large surface area which results in efficient release and distribution of the materials onto fabrics by the tumbling action of the dryer.

The substrates used in the articles can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

It is known that most substances are able to absorb a liquid substance to some degree; however, the term "absorbent", as used herein, is intended to mean a substrate with an absorbent capacity (i.e., a parameter representing a substrate's ability to take up and retain a liquid) from 4 to 12, preferably 5 to 7 times its weight of water.

If the substrate is a foamed plastics material, the absorbent capacity is preferably in the range of 15 to 22, but some special foams can have an absorbent capacity in the range from 4 to 12.

Determination of absorbent capacity values is made by using the capacity testing procedures described in U.S. Federal Specifications (UU-T-595b), modified as follows:

1. tap water is used instead of distilled water;
2. the specimen is immersed for 30 seconds instead of 3 minutes;
3 draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., Kraft or bond having a basis weight of about 32 pounds per 3,000 square feet) has an absorbent capacity of 3.5 to 4; commercially available household one-ply towel paper has a value of 5 to 6; and commercially available two-ply household toweling paper has a value of 7 to about 9.5.

Suitable materials which can be used as a substrate in the invention herein include, among others, sponges, paper, and woven and non-woven cloth, all having the necessary absorbency requirements defined above.

The preferred non-woven cloth substrates can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e. an array of fibers in a carded web wherein partial orientation of the fibers is frequently present, as well as a completely haphazard distributional orientation), or substantially aligned. The fibers or filaments can be natural (e.g. wool, silk, jute, hemp, cotton, linen, sisal, or ramie) or synthetic (e.g. rayon, cellulose ester, polyvinyl derivatives, polyolefins, polyamides, or polyesters).

The preferred absorbent properties are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a composition by means of intersectional or capillary action. Thus, any thickness necessary to obtain the required absorbent capacity can be used.

When the substrate for the composition is a non-woven cloth made from fibers deposited haphazardly or in random array on the screen, the articles exhibit excellent strength in all directions and are not prone to tear or separate when used in the automatic clothes dryer.

Preferably, the non-woven cloth is water-laid or air-laid and is made from cellulosic fibers, particularly from regenerated cellulose or rayon. Such non-woven cloth can be lubricated with any standard textile lubricant. Preferably, the fibers are from 5mm to 50mm in length and are from 1.5 to 5 denier. Preferably, the fibers are at least partially oriented haphazardly, and are adhesively bonded together with a hydrophobic or substantially hydrophobic binder-resin. Preferably, the cloth comprises about 70% fiber and 30% binder resin polymer by weight and has a basis weight of from about 18 to 45 g per square meter.

In applying the fabric conditioning composition to the absorbent substrate, the amount impregnated into and/or coated onto the absorbent substrate is conveniently in the weight ratio range of from about 10:1 to 0.5:1 based on the ratio of total conditioning composition to dry, untreated substrate (fiber plus binder). Preferably, the amount of the conditioning composition ranges from about 5:1 to about 1:1, most preferably from about 3:1 to 1:1, by weight of the dry, untreated substrate.

According to one preferred embodiment of the invention, the dryer sheet substrate is coated by being passed over a rotogravure applicator roll. In its passage over this roll, the sheet is coated with a thin, uniform layer of molten fabric softening composition contained in a rectangular pan at a level of about 15 g/square yard. Passage of the substrate over a cooling roll then solidifies the molten softening composition to a solid. This type of applicator is used to obtain a uniform homogeneous coating across the sheet.

Following application of the liquefied composition, the articles are held at room temperature until the composition substantially solidifies. The resulting dry articles, prepared at the composition substrate ratios set forth above, remain flexible; the sheet articles are suitable for packaging in rolls. The sheet articles can optionally be slitted or punched to provide a non-blocking aspect at any convenient time if desired during the manufacturing process.

The fabric conditioning composition employed in the present invention includes certain fabric softeners which can be used singly or in admixture with each other.

Fabric Softener Component

Fabric softeners suitable for use herein are selected from the following classes of compounds:

(i) Cationic quaternary ammonium salts. The counterion is methyl sulfate or any halide, methyl sulfate being preferred for the drier-added articles of the invention. Examples of cationic quaternary ammonium salts include, but are not limited to:

(1) Acyclic quaternary ammonium salts having at least two $C_{8-30}$, preferably $C_{12-22}$ alkyl chains, such as: ditallowdimethyl ammonium methylsulfate, di(hydrogenated tallow)dimethyl ammonium methylsulfate, distearyldimethyl ammonium methylsulfate, dicocodimethyl ammonium methylsulfate and the like;

(2) Cyclic quaternary ammonium salts of the imidazolinium type such as di(hydrogenated tallow)-dimethyl imidazolinium methylsulfate, 1-ethylene-bis(2-tallow-1-methyl) imidazolinium methylsulfate and the like;

(3) Diamido quaternary ammonium salts such as: methyl-bis(hydrogenated tallow amidoethyl)-2-hydroxyethyl ammonium methyl sulfate, methyl bis(tallowamidoethyl)-2-hydroxypropyl ammonium methylsulfate and the like;

(4) Biodegradable quaternary ammonium salts such as N,N-di(tallowoyl-oxy-ethyl)-N,N,-dimethyl ammonium methyl sulfate and N,N-di(tallowoyl-oxypropyl)-N,N-dimethyl ammonium methyl sulfate. When fabric conditioning compositions employ biodegradable quaternary ammonium salts, pH of the composition is preferably adjusted to between about 2 and about 5. Biodegradable quaternary ammonium salts are described, for example, in U.S. Pat. Nos. 4,137,180, 4,767,547 and 4,789,491 incorporated by reference herein.

(ii) Tertiary fatty amines having at least one and preferably two C8 to C30, preferably C12 to C22 alkyl chains. Examples include hardened tallow amine and cyclic amines such as 1-(hydrogenated tallow)amidoethyl-2-(hydrogenated tallow) imidazoline. Cyclic amines which may be employed for the compositions herein are described in U.S. Pat. No. 4,806,255 incorporated by reference herein.

(iii) Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Examples of these carboxylic acids are commercial grades of stearic acid and the like which may contain small amounts of other acids.

(iv) Esters of polyhydric alcohols such as sorbitan esters or glycerol stearate. Sorbitan esters are the condensation products of sorbitol or iso-sorbitol with fatty acids such as stearic acid. Preferred sorbitan esters are monoalkyl. A common example of sorbitan ester is SPAN 60 (ICI) which is a mixture of sorbitan and isosorbide stearates.

(v) Fatty alcohols, ethoxylated fatty alcohols, alkyl phenols, ethoxylated alkyl phenols, ethoxylated fatty amines, ethoxylated monoglycerides and ethoxylated diglycerides.

(vi) Mineral oils, and polyols such as polyethylene glycol.

These softeners are more definitively described in U.S. Pat. No. 4,134,838 incorporated by reference herein. Preferred fabric softeners for use herein are acyclic quaternary ammonium salts, di(hydrogenated)-tallowdimethyl ammonium methylsulfate is most preferred for dryer articles of this invention. Especially preferred are mixtures of di(hydrogenated)tallow-dimethyl ammonium methylsulfate with fatty acids, particularly stearic acid.

The amount of the fabric softening composition on the sheet is subject to normal coating parameters such as, for example, viscosity and melting point of the fabric softening component and is typically about 0.5 grams to about 5 grams, preferably about 1 gram to about 3.5 grams. The fabric softening composition employed in the present invention contains about 0.1% to about 95% of the fabric softening component. Preferably from about 10% to about 80% and most preferably from about 30% to about 70% of the fabric softening component is employed herein to obtain optimum softening at minimum cost. When the fabric softening component includes a quaternary ammonium salt, the salt is used in the amount of about 10% to about 80%, preferably about 30% to about 70%.

Silicone

The second essential ingredient of the fabric softening composition employed in the present invention is an organosilicone.

Organosilicones employed in the present invention (also termed herein as compatible silicones) are capable of forming compatible mixtures with the fabric softeners listed above.

The organosilicones employed herein have a $\%CH_2$ content of about 25% to about 90%. The $\%\ CH_2$ content is defined as $$\%\ CH_2 = \frac{\text{number of methylene } (CH_2) \text{ groups}}{\text{number of methylene groups and methyl groups}} \times 100\%$$

The organosilicones included in the fabric conditioning compositions of the invention contain at least one unit of Formula A:

$$R^1-\underset{\underset{Rm}{|}}{Si}O_{(3-m)/2}$$

wherein m is a number from 0 to 2 and R is a mono valent hydrocarbon radical. The value of $(3-m)/2$ in Formula A means the ratio of oxygen atoms to silicon atoms, i.e. $SiO_{\frac{1}{2}}$ means one oxygen is shared between two silicon atoms.

$R^1$ in Formula A is selected from the group consisting of:

i) a hydrocarbon radical having from 6 to 45 carbon atoms, preferably from 8 to 18 carbon atoms and which may be saturated, unsaturated, cyclic, acyclic, alkyl or aromatic;

ii) a unit of Formula A1:

$$-(CH_2)_a-(\underset{\underset{R^2}{|}}{N}-CH_2CH_2)_b-\underset{\underset{R^2}{|}}{N}-R^2$$

wherein a is a number of at least 1, preferably 3; b is a number from 0 to 10, preferably 1; $R^2$ is $-\underset{\underset{R_4}{|}}{CH}-\underset{\underset{OH}{|}}{CH}-R^3$.

$R^3$ is a hydrocarbon radical having from 4 to 40 carbon atoms preferably from 8 to 18 carbon atoms and may be saturated, unsaturated, cyclic, acyclic, alkyl or aromatic; and $R^4$ is hydrogen or a hydrocarbon radical having from 1 to 40 carbon atoms, preferably hydrogen; and iii) a unit of Formula A2

$$-R^7-\underset{\underset{R^6}{|}}{N}-R^5$$

wherein $R^5$ and $R^6$ are independently selected from hydrogen or a hydrocarbon radical having from 1 to 45 carbon atoms which may be saturated, unsaturated, cyclic, acyclic, alkyl or aromatic and at least one of $R^5$ and $R^6$ is a hydrocarbon radical having from 6 to 45 carbon atoms, $R^7$ is $$-R^8-\underset{\underset{OH}{|}}{CH}-CH_2-.$$

wherein $R^8$ is a divalent organic radical having from 1 to 12 carbon atoms and may be saturated, unsaturated, cyclic, acyclic, alkyl or aromatic, and preferably is $-CH_2CH_2CH_2-O-CH_2-$.

Thus, organosilicones employed in the present invention include alkylsilicones and alkylaminosilicones which satisfy the structural parameters described above and which have a % methylene ($\%CH_2$) content of about 25% to about 90%. Compatibility of the organosilicones herein with fabric softening agents is related to the $\%CH_2$ content of the organosilicones.

The preferred range of the $\%CH_2$ content for the silicones herein is about 40% to about 90%, more preferably about 50% to about 85%, and most preferably about 50% to about 75% to increase the degree of compatibility of the organosilicones with various fabric softening agents.

The organosilicones included in the compositions herein may be linear, branched, or partially crosslinked, preferably linear, and may range from fluid, liquid to viscous liquid, gum and solid.

An example of an alkylsilicone suitable for use herein is:

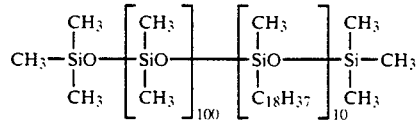

An example of a suitable alkylaminosilicone containing the unit of Formula A1 is:

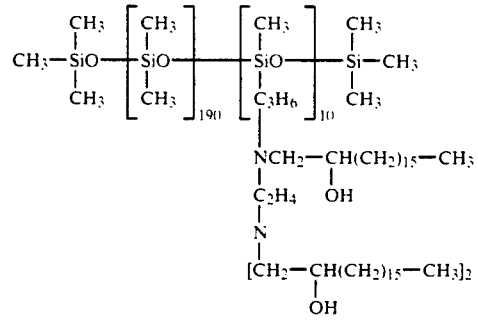

An example of an alkylaminosilicone containing the unit of Formula A2 is:

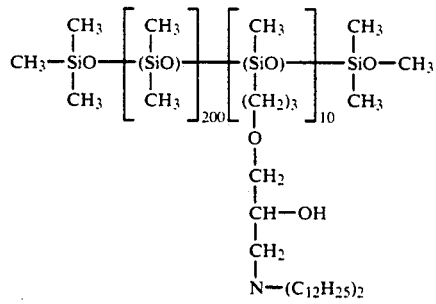

Alkylsilicones employed in this invention may be produced by reacting a hydrosiloxane co-polymer with a hydrocarbon having 6 to 45 carbon atoms and having a terminal vinyl functionality. Such reactions are described, for example, in Chemistry and Technology of Silicones by Walter Noll, Academic Press, N.Y. (1968), pages 49–51 and 219–226. Commercially available alkylsilicones suitable for use herein are, for example, Masil 264, Masil 265, Masil 265 HV from Mazer International Corp. and ABIL - Wax 9800 or ABIL - Wax 9801 from Th. Goldschmidt AG.

Alkylaminosilicones employed in this invention may be produced by 1) treating silicones containing primary or secondary amine functional groups with epoxides such as ethylene oxide to form alkylaminosilicones having the unit of Formula A1, or 2) by treating epoxysilicones with primary or secondary amines such as dicocoamine to form alkylaminosilicones having the unit of Formula A2.

The modified alkylaminosilicones of the invention having the unit of Formula A1 may be prepared by mixing epoxide compounds with aminosilicones in a pressure reactor and heating for about 24 hours, after Which the unreacted epoxide compound is vacuum stripped off. The amount of epoxide to be used is calculated based upon the number of amine functional groups on the alkylaminosilicone. Preferably, two epoxides are reacted for every primary amine and one epoxide for every secondary amine, in order to convert them to tertiary amines. A stoichiometric amount or up to 25% excess of epoxide can be used. The reaction is preferably conducted between 25° C. and 150° C., especially between 50° C. and 100° C. The pressure is preferably maintained from 50 psi to 300 psi, particularly from 50 psi to 150 psi. Typical aminosilicone starting compounds would include Dow Corning Q2-8075. The art of making alkylaminosilicones having the unit of Formula A1 is disclosed in Examples 1 and 2 herein and in the copending patent applications of Lin et al. entitled "Hydroxylhydrocarbyl Modified Aminoalkyl Silicones", Ser. No. 449,360 filed Dec. 6, 1989.

The modified alkylaminosilicones having the unit of Formula A2 may be prepared by mixing epoxysilicones, secondary amines, and a solvent such as isopropanol or toluene, and heating the mixture at reflux for about 24 hours, after which the solvent is removed by distillation or vacuum stripping. The amount of amine to be used is calculated based upon the number of epoxy functional groups on the epoxysilicone. Preferably, one secondary amine is reacted for every epoxy functional group in order to convert the amine to tertiary amine. A stoichiometric amount or up to 25% excess of amine can be used. The reaction is preferably conducted between 50° C. and 150° C., especially between 75° C. and 110° C. The reaction is preferably conducted at atmospheric pressure, but may be conducted in a pressure reactor with the pressure being maintained from 50 psi to 300 psi.

The modified alkylaminosilicones employed in this invention contain amine groups which may be quaternized with, for example, alkyl halide or methyl sulfate, or may be protonated with Lewis acid such as hydrochloric acid, acetic acid, citric acid, formic acid and the like.

Alkylsilicones and alkylaminosilicones employed herein may, in addition to the units of Formula A, contain secondary units selected from the group consisting of a unit of Formula B1 and a unit of Formula B2:

$$R^{11}-O(\underset{\underset{R^9}{|}}{CH_2CHO})_c R^{10}-\underset{\underset{R_y}{|}}{(SiO)}_{3y/2} \qquad \text{Formula B1}$$

-continued $$R^{11}-O(CH_2CH_2CH_2CH_2O)_d-R^{10}-\underset{\underset{R_z}{|}}{(SiO)}_{3z/2} \qquad \text{Formula B2}$$

wherein $R^{11}$ radical having from 1 to 40 carbon atoms, preferably is $CH_3$; $R^9$ is a hydrocarbon radical having from 1 to 3 carbon atoms; $R^{10}$ is oxygen or alkylene having from 1 to 8 carbon atoms, preferably propylene; y and z are numbers from 0 to 2; and c and d are numbers from 0 to 50, preferably from 2 to 15.

Organosilicones preferred for use herein have the $\%CH_2$ of about 40% to about 90% and are either alkylaminosilicones having the unit of Formula A1 or alkylsilicones.

The weight ratio of the organosilicone to the fabric softening component in the fabric conditioning compositions employed herein is from about 100:2 to about 1:100, preferably from about 2:100 to about 20:100, but must be such that a compatible mixture can be formed. The minimum weight ratio at which the compatible mixtures can be formed is determined experimentally as part of the Silicone/Softener Compatibility Test (SSCT) described herein. The amount of the organosilicone is governed by the ratio at which the compatible mixture can be formed. The amount of organosilicone employed herein generally ranges from about 0.1% to about 20%, and is preferably at least about 3%.

Silicone/Softener Compatibility Test (SSCT)

As described above, mixtures defined as compatible herein include mutually soluble as well as mutually stable dispersible mixtures. Compatibility of the fabric conditioning mixtures herein depends on the structure and the $\%CH_2$ content of the organosilicone and the particular fabric softeners employed in the mixture. SSCT provides a basis for selecting appropriate combinations of the fabric softening component and the organosilicone.

The test may be used to determine the compatibility at a particular weight ratio of interest or to determine a minimum concentration of the silicone at which a compatible mixture of the silicone and the fabric softening component is formed.

SSCT is conducted as follows: a 10 gram sample of the fabric softener or a combination of fabric softeners is placed into a clear glass flask equipped with a stirring mechanism, such as a magnetic stirrer. If either the fabric softener or the silicone is a solid at room temperature, it is melted before the test is begun with the test taking place above the melting point of the fabric softener or the silicone. The silicone of interest is slowly introduced with, conveniently, a Pasteur pipet into the flask, with stirring. It is estimated that the weight of one drop represents about 1% silicone concentration, so the silicone is mixed with the fabric softener 1% at a time. Thus, the lowest concentration of the silicone in the mixture is about 1%.

If the resulting mixture of the fabric softening agent and the silicone stays clear over the entire investigated range of the silicone, this indicates that the components of the mixture are mutually soluble over the investigated concentration range and, accordingly, are compatible. Clear mixtures are defined herein as mixtures having about 90% transmittance when measured with a visible light probe (one centimeter pathlegth) against distilled water background using Brinkman PC800 colorimeter.

The mixture may also become cloudy indicating that the silicone and the fabric softener are not mutually soluble at that weight % of the silicone. In this case, if the mixture became cloudy, the weight percent of the silicone added to produce cloudiness is calculated. This number, termed compatibility $\alpha$, then represents the weight percent of the silicone to produce a cloudy mixture. Cloudy samples are placed in an oven at 100° C. for at least two hours, then cooled to room temperature and inspected. Samples which have completely separated into distinct layers are incompatible and are not useful for the invention. Samples which maintain a stable, dispersed character are compatible and, hence, useful in the invention.

It is sufficient, for practical applications, to investigate the silicone concentration range of up to about 30%. However, the entire range up to 100% of the silicone concentration may be investigated if desired. When the entire range of the silicone concentration is to be investigated, the silicone is added until the mixture contains about 60% by weight of the silicone. Silicone addition is then stopped, and the experiment is repeated by adding the fabric softener to a 10 gram sample of the silicone. In those samples that became cloudy, the weight percent of the softener added to produce cloudiness is calculated and subtracted from 100, the resulting number is termed herein compatibility $\beta$.

$\alpha$ compatibility reflects compatibility of the mixtures containing a fabric softener as a major component, whereas $\beta$ compatibility reflects compatibility of the mixtures containing a silicone as a major component. Minimal difference between $\beta$ and $\alpha$ ($\beta-\alpha$) reflects degree of compatibility of the mixture: more compatible mixtures have a lower number for $\beta-\alpha$.

Preferably, the silicone and the fabric softening component are compatible at a silicone concentration of at least about 2%.

Mutually soluble and clear mixtures of the silicone and the fabric softening component indicate the highest degree of compatibility and are preferred.

Various additives may be used in combination with the compatible mixture of the fabric softening component and the compatible silicone. The additives are used in the amounts that do not substantially affect the compatibility of the mixture and include small amounts of incompatible silicones, such as predominantly linear polydialkylsiloxanes, e.g. polydimethylsiloxanes; soil release polymers such as block copolymers of polyethylene oxide and terephthalate; amphoteric surfactants; anionic soaps; and zwitterionic quaternary ammonium compounds. Smectite type inorganic clays improve the processing of the compositions and do not settle out and, hence, do not adversely affect the homogeneity of the compatible mixtures and may be used in the amounts of up to about 10%.

Other optional ingredients include optical brighteners or fluorescent agents, perfumes, colorants, germicides and bactericides.

The organosilicone and the fabric softening component which have been determined by the SSCT to form a compatible mixture are heated and mixed, and the resulting fabric conditioning mixture is coated onto a flexible substrate.

The following Examples will more fully illustrate the embodiments of this invention. All parts, percentages and proportions referred to herein and in the appended claims are by weight unless otherwise indicated.

EXAMPLE 1

The alkylaminosilicone $MD_{190}D^*_{10}M$, Where $M=Me_3SiO_{0.5}$,

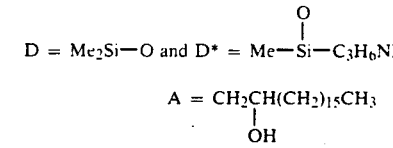

$$D = Me_2Si{-}O \text{ and } D^* = Me{-}\overset{\overset{\displaystyle O}{|}}{Si}{-}C_3H_6NHC_2H_4NA_2 \text{ and}$$

$$A = CH_2\underset{\underset{\displaystyle OH}{|}}{CH}(CH_2)_{15}CH_3$$

is a condensation product of the starting aminosilicone (where A=H) and 1,2 epoxyoctadecane. The compound was prepared by placing the starting aminosilicone (61.16 g), 1,2 epoxyoctadecane (38.84 g) and 2-propanol (60.0 g) in a reaction vessel and heating to 80° C. for 24 hours. The reaction vessel consisted of a three neck round bottom flask containing a stirrer, a reflux condenser and a thermometer. The 2-propanol was then stripped off with a $N_2$ sparge at 100° C. as described in the Lin et al. applications mentioned above.

MD190D*10M has $\%CH_2$ equal 56.62.

EXAMPLE 2

A "T" structure modified alkylaminosilicone, having $\%CH_2$ equal 52.50 is prepared according to Example 1 except that the silicone is $MD_{10.4}T^*M_2$. The alkylaminosilicone is of the structure:

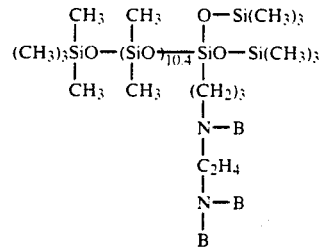

In the starting aminoalkylsilicone, B=H whereas in the modified aminoalkylsilicone, $B=CH_2CHOH{-}(CH_2)_9CH_3$.

In the process, 34.7 g aminoalkylsilicone, 34.4 g 1,2-epoxydodecane and 17.4 g 2-propanol were charged to the reaction vessel following the procedures of Example 1.

EXAMPLE 3

Effect of the $\%CH_2$ content of various silicones as indicated in Table I on the compatibility with Adogen 442 (di-tallow dimethyl ammonium chloride from Sherex Corp.) was investigated by mixing the silicones with Adogen 442, following the SSCT procedure.

The results that were generated are summarized in Table I. Samples 3 and 4 were synthesized in Examples 1 and 2 respectively.

TABLE I

| # | Silicone | % $CH_2$ | Compatible |
|---|---|---|---|
| 1. | DC 200[1] | 0 | no |
| 2. | DC SSF[2] | 0 | no |
| 3. | $MD_{190}D^*10^M$ | 56.62 | yes |
| 4. | $MD_{10.4}T^*M_2$ | 52.50 | yes |

[1]Linear polydimethylsiloxane, supplied by Dow Corning, viscosity = 1000 cst
[2]Aminosilicone supplied by Dow Corning, amine neutral equivalent = 2000, viscosity = 130 cst.

The silicones of samples 3 and 4 were mutually soluble and, hence, compatible with Adogen 442 at silicone concentration of 5% by weight of the mixture. However, silicones 1 and 2, which are not within the scope of the present invention, were not compatible with Adogen 442 at 5% or even at 25% of silicone.

EXAMPLES 4-6

The compatibility of various fabric softening agents with various silicones was determined by the SSCT. The entire concentration range up to 100% of the silicones was investigated. Samples that remained clear over the entire range of silicone concentration were labeled "completely soluble." For samples that became cloudy stability of the dispersions was ascertained and $\alpha$ and $\beta$ compatibility values were determined by the SSCT.

The silicones that were investigated are listed in Table II. In the silicone formulas of Table II $M = Me_3Si\text{-}O_{0.5}$, $D = Me_2Si\text{-}O$, $$D^* = Me-\overset{O}{\overset{|}{Si}}-R'$$

and R' is as indicated in Table II.

TABLE II

| Code | Formula | R' | % CH2 |
|---|---|---|---|
| A | Polydimethylsiloxane ($\eta$ = 1000 cst) | — | 0 |
| B | MD100D*5M | $C_8H_{17}$- | 14 |
| C | MD100D*5M | $C_{18}H_{37}$ | 28 |
| D | MD400D*20M | $C_{18}H_{37}$- | 28 |
| E | MD100D*10M | $C_{18}H_{37}$- | 43 |
| F | MD95D*24M | $C_{12}H_{25}$ | 57 |

EXAMPLE 4

In this example, mixtures of the silicones listed in Table II with mineral oil were investigated using the SSCT. The mineral oil used was Fisher Light Mineral oil. The results that were generated are summarized in Table III.

TABLE III

| | Compatibility with Mineral Oil | | |
|---|---|---|---|
| SILICONE | $\alpha$ COMPAT-IBILITY | $\beta$ COMPAT-IBILITY | COMPATIBLE (YES/NO) |
| A | 1 | 95 | NO |
| B | 4 | 80 | NO |
| C | COMPLETELY SOLUBLE | | YES |
| E | COMPLETELY SOLUBLE | | YES |
| F | COMPLETELY SOLUBLE | | YES |

As determined by the SSCT, silicones C, E and F having the structural requirements and $\%CH_2$ recited by the present invention form compatible mixtures with mineral oil.

EXAMPLE 5

In this example, mixtures of the silicones listed in Table II with various cationic quaternary fabric softening agents were investigated using the SSCT.

The results that were generated are summarized in Tables IV, V and VI.

TABLE IV

| | Compatibility with Varisoft 137[1] | | |
|---|---|---|---|
| SILICONE | $\alpha$ COMPAT-IBILITY | $\beta$ COMPAT-IBILITY | COMPATIBLE (YES/NO) |
| A | 2 | 97 | NO |
| B | 2 | 98 | NO |
| C | 2 | 96 | NO |
| E | 7 | 93 | YES |
| F | 7 | 90 | YES |

[1]Varisoft 137 = di(hydrogenated)tallow dimethyl ammonium methylsulfate from Sherex.

TABLE V

| | Compatibility with Varisoft 445[1] | | |
|---|---|---|---|
| SILICONE | $\alpha$ COMPAT-IBILITY | $\beta$ COMPAT-IBILITY | COMPATIBLE (YES/NO) |
| A | 2 | 97 | NO |
| E | 10 | 97 | YES |
| F | — | 97 | YES |

[1]Varisoft 445 = di(hydrogenated)tallow imidazolinium methylsulfate from Sherex.

TABLE VI

| | Compatibility with Varisoft 110[1] | | |
|---|---|---|---|
| SILICONE | $\alpha$ COMPAT-IBILITY | $\beta$ COMPAT-IBILITY | COMPATIBLE (YES/NO) |
| A | 1 | 98 | NO |
| E | 5 | 90 | YES |
| F | 5 | 90 | YES |

[1]Varisoft 110 = methyl bis-(hydrogenated tallow amidoethyl) 2-hydroxyethyl ammonium methylsulfate from Sherex

EXAMPLE 6

In this example, mixtures of the silicones listed in Table II with various nonionic fabric softening agents were investigated using the SSCT.

Results that were generated are summarized in Tables VII, VIII, IX and X.

TABLE VII

| | Compatibility with Neodol 45-7[1] | | |
|---|---|---|---|
| SILICONE | $\alpha$ COMPAT-IBILITY | $\beta$ COMPAT-IBILITY | COMPATIBLE (YES/NO) |
| A | 1 | 99 | NO |
| B | 1 | 99 | NO |
| D | 2 | 99 | NO |
| F | 5 | 93 | YES |

[1]Neodol 45-7 = ethoxylated fatty alcohol from Shell.

TABLE VIII

| | Compatibility with Adogen 345D[1] | | |
|---|---|---|---|
| SILICONE | $\alpha$ COMPAT-IBILITY | $\beta$ COMPAT-IBILITY | COMPATIBLE (YES/NO) |
| A | 2 | 60 | NO |
| B | COMPLETELY SOLUBLE | | YES |
| D | COMPLETELY SOLUBLE | | YES |
| E | COMPLETELY SOLUBLE | | YES |
| F | COMPLETELY SOLUBLE | | YES |

[1]Adogen 345D = di(hydrogenated)tallow dimethyl amine from Sherex.

TABLE IX

| SILICONE | Compatibility with PEG 600[1] α COMPAT-IBILITY | β COMPAT-IBILITY | COMPATIBLE (YES/NO) |
|---|---|---|---|
| A | 2 | 99 | NO |
| B | 2 | 98 | NO |
| D | 4 | 95 | NO |
| E | 4 | 95 | YES |
| F | 4 | 95 | YES |

[1]PEG 600 = Polyethylene Glycol.

TABLE X

| SILICONE | Compatibility with isostearic acid α COMPAT-IBILITY | β COMPAT-IBILITY | COMPATIBILE (YES/NO) |
|---|---|---|---|
| A | 3 | 95 | NO |
| F | 3 | 96 | YES |

Examples 3–6 demonstrate that mutual compatibility between the fabric softening component and organosilicones may be easily determined by the SSCT and that the compatibility depends on the structure and $\%CH_2$ content of the silicone as well as the particular fabric softening component employed in the mixture. Although silicone C was highly compatible (mutually soluble) with mineral oil in Example 3 and with Adogen 345D in Example 6, it was less compatible with Varisoft 137 of Example 4, i.e. a cloudy mixture was formed at 2% of silicone. However, silicone C was more compatible with Varisoft 137 in Example 4 than polydimethylsiloxane, since β compatibility was lower for silicone C than for polydimethylsiloxane. Results in Table VIII indicate that amines have the highest degree compatibility with organosilicones, since silicone B, which has the $\%CH_2$ content of 14% and is not within the scope of this invention is still compatible with di(hydrogenated)tallow dimethyl amine. Silicones E and F, having a high $\%CH_2$ content (43% and 57% respectively) were the most compatible with all softeners tested.

EXAMPLE 7

Two fabric softening sheets, A and B were prepared as follows:

The ingredients of a fabric conditioning composition as listed below were mixed in the melt. 500 g of the prepared fabric conditioning mixture was placed in the pan of a two-roll coating machine and coated onto a spun-bonded polyester non-woven material. The fabric softening articles thus manufactured contained about 1.6 g of solidified softening composition. The articles of manufacture were then placed into a tumble dryer machine which already contained 2.2 kg of prewashed clothing, including terry towelling softness monitors. The fabrics were then tumble dried with the fabric softening article until dry and the softening benefit was evaluated by a 20 member panel.

Fabric Conditioning Formulation For Sheet A a) 10% of a silicone not suitable for use in the present invention (silicone B from Table II)
b) 70% di(hydrogenated)tallow dimethyl ammonium methylsulfate
c) 20% stearic acid

Fabric Conditioning Formulation For Sheet B a) 7% of a silicone within the scope of this invention (silicone F from Table II)
b) 70% di(hydrogenated)tallow dimethyl ammonium methylsulfate
c) 23% stearic acid

Observations And Results

Sheet A—Due to the incompatible nature of the silicone, the silicone separated from the softening component during the coating process. The articles thus contained unknown amounts of the silicone. Sheet B—The compatible silicone of the invention and the softening component formed a compatible mixture which remained homogeneous during the coating process as it was transferred to the substrate indicating that the substrate was uniformly and evenly coated.

A 20 member panel judged the towelling monitors for both sheet A and sheet B to have superior softness vs. towels prepared in an identical fashion but dried without softener.

This invention has been described with respect to certain preferred embodiments and various modifications thereof will occur to persons skilled in the art in the light of the instant specification and are to be included within the spirit and purview of this application and the scope of the appended claims.

What is claimed is:

1. An article for conditioning fabrics which provides for release of a fabric conditioning composition within an automatic laundry dryer at dryer operating temperatures comprising a flexible substrate and a fabric conditioning composition, carried on said substrate, the weight ratio of total conditioning composition to the substrate being from about 10:1 to 0.5:1, said composition comprising:

a) a fabric softening component selected from:
   i) cationic quaternary ammonium salts;
   ii) nonionic fabric softeners selected from the group consisting of tertiary amines having at least one $C_{8-30}$ alkyl chain, esters of polyhydric alcohols, fatty alcohols, ethoxylated fatty alcohols, alkylphenols, ethoxylated alkylphenols, ethoxylated monoglycerides, ethoxylated diglycerides, ethoxylated fatty amines, mineral oils, polyols, and mixtures thereof;
   iii) carboxylic acids having at least 8 carbon atoms; and
   iv) mixtures thereof; and b) an organosilicone having a $\%\ CH_2$ content of about 25% to about 90% and having at least one unit of Formula A:

$$R^1-\underset{\underset{Rm}{|}}{Si}-O_{(3-m)/2}$$

wherein m is a number from 0 to 2, R is a mono valent hydrocarbon radical and $R^1$ is selected from the group consisting of:

i) a unit of Formula A1

$$-\underset{\underset{R^2}{|}}{(CH_2)_a}-(N-\underset{\underset{R^2}{|}}{CH_2CH_2})_b-N-R^2$$

wherein a is a number of at least 1, b is a number from 0 to 10, $$R^2 \text{ is } -\underset{\underset{R^4}{|}}{CH}-\underset{\underset{OH}{|}}{CH}-R^3,\ R^3 \text{ is}$$

a hydrocarbon radical having from 4 to 40 carbon atoms and $R^4$ is hydrogen or hydrocarbon radical having from 1 to 40 carbon atoms; and ii) a unit of Formula A2

$$-R^7-\underset{\underset{R^6}{|}}{N}-R^5$$

wherein $R^5$ and $R^6$ are independently selected from hydrogen or a hydrocarbon radical having from 1 to 45 carbon atoms and at least one of $R^5$ and $R^6$ is a hydrocarbon radical having from 6 to 45 carbon atoms, $R^7$ is $$-R^8-\underset{\underset{OH}{|}}{CH}-CH_2-.$$

where $R^8$ is a divalent organic radical having from 1 to 12 carbon atoms, wherein said fabric softening component and said organosilicone form a compatible mixture as determined by Silicone/Softener Compatibility Test and wherein the weight ratio of the organosilicone to the fabric softening component is from about 100:2 to about 1:100.

2. The article of claim 1 wherein the $\%CH_2$ content of said organosilicone is about 40% to about 90%.

3. The article of claim 1 wherein an amount of said organosilicone is about 0.1% to about 20% by weight of said composition.

4. The article of claim 1 wherein an amount of said organosilicone is about 3% to about 20% by weight of said composition.

5. The article of claim 1 wherein $R^1$ includes from 8 to 18 carbon atoms.

6. The article of claim 1 wherein a is 3 and b is 1.

7. The article of claim 1 wherein $R^3$ includes from 8 to 18 carbon atoms.

8. The article of claim 1 wherein $R^4$ is hydrogen.

9. The article of claim 1 wherein m is 1.

10. The article of claim 1 wherein $R^8$ is $-(CH_2)_3-O-CH_2-$.

11. The article of claim 1 wherein at least one nitrogen atom of said unit of Formula A1 is protonated or quaternized.

12. The article of claim 1 wherein the nitrogen atom of said unit of Formula A2 is protonated or quaternized.

13. The article of claim 1 wherein said nonionic softener is a fatty tertiary amine having two $C_{8-30}$ alkyl chains.

14. The article of claim 13 wherein said fatty tertiary amine is selected from the group consisting of di(hydrogenated)tallowmethylamine and di(hydrogenated)-tallowimidazoline.

15. The article of claim 1 wherein said nonionic softener is selected from the group consisting of glycerol stearate, and a sorbitan ester.

16. The article of claim 1 wherein said fatty acid is stearic acid.

17. The article of claim 1 wherein said cationic quaternary ammonium salt is selected from the group consisting of acyclic quaternary ammonium salts having at least two $C_{8-30}$ alkyl chains, quaternary imidazolinium salts, diamido quaternary ammonium salts, biodegradable quaternary ammonium salts and mixtures thereof.

18. The article of claim 1 wherein said cationic quaternary ammonium salt is selected from the group dihydrogenatedtallowamidazolinium consisting of dihydrogenatedtallowdimethyl ammonium chloride and ditallowimidazolinium chloride.

19. The article of claim 1 wherein said flexible substrate is in a sheet configuration.

20. The article of claim 1 wherein said organosilicone further comprises at least one secondary unit selected from the group consisting of:

i) a unit of Formula B1

$$R^{11}-O(\underset{\underset{R^9}{|}}{CH_2CHO})_cR^{10}-\underset{\underset{Ry}{|}}{(SiO)}_{3y/2}$$

and ii) a unit of Formula B2

$$R^{11}-O(CH_2CH_2CH_2CH_2O)_d-R^{10}-\underset{\underset{Rz}{|}}{(SiO)}_{3z/2}$$

wherein $R^9$ is a hydrocarbon radical having from 1 to 3 carbon atoms; $R^{10}$ is oxygen or a hydrocarbon radical having from 1 to 8 carbon atoms; $R^{11}$ is a hydrocarbon radical having from 1 to 40 carbon atoms; y and z are numbers from 0 to 2; and c and d are numbers from 0 to 50.

21. The article of claim 20 wherein $R^8$ is methyl.

22. The article of claim 20 wherein $R^{10}$ is propylene.

23. The article of claim 20 wherein the $\%CH_2$ content of said organosilicone is about 40% to about 90%.

24. The article of claim 20 wherein $R^1$ is a hydrocarbon radical having from 8 to 18 carbon atoms.

25. A method of conditioning laundry in a dryer comprising contacting said laundry with the fabric conditioning article of claim 1.

* * * * *